United States Patent [19]

Toy et al.

[11] Patent Number: 4,687,280

[45] Date of Patent: Aug. 18, 1987

[54] HEAT ACTIVATABLE SEALING PISTON

[75] Inventors: Lester T. Toy, Fremont; Daniel Magay, Los Altos, both of Calif.

[73] Assignee: Raychem Corporation, Menlo Park, Calif.

[21] Appl. No.: 723,699

[22] Filed: Apr. 16, 1985

Related U.S. Application Data

[63] Continuation-in-part of Ser. No. 604,791, Apr. 27, 1984, abandoned.

[51] Int. Cl.[4] ..... H01R 4/02

[52] U.S. Cl. ..... 439/874; 29/859; 29/860; 174/84 R

[58] Field of Search ..... 29/857–860, 29/868, 869; 174/84 R, 87, 77 R, DIG. 8; 339/278 R, 278 A, DIG. 1, 30, 102 R, 275 B

[56] References Cited

U.S. PATENT DOCUMENTS 4,283,596 8/1981 Vidakovits et al. ..... 174/87

4,304,959 12/1981 Vidakovits et al. ..... 174/DIG. 8

4,484,022 11/1984 Eilentropp ..... 29/869

4,504,699 3/1985 Dones et al. ..... 174/DIG. 8

FOREIGN PATENT DOCUMENTS 2533023 10/1977 Fed. Rep. of Germany ... 174/DIG. 8

3037632 5/1982 Fed. Rep. of Germany .

*Primary Examiner*—Eugene F. Desmond

*Assistant Examiner*—Paula A. Austin

*Attorney, Agent, or Firm*—Edith A. Rice; Herbert G. Burkard

[57] ABSTRACT

A heat activatable sealing piston comprising a cylinder of polymeric material radially expandable on application of heat. The piston can be incorporated into thermal actuators of various types. In a preferred embodiment, the sealing piston is used in an electrical connector, together with a gas generating means to force solder between an electrical conductor inserted into the connector and the walls of the tubular connector.

13 Claims, 3 Drawing Figures

HEAT ACTIVATABLE SEALING PISTON

This application is a continuation-in-part of U.S. application Ser. No. 604,791 now abandoned, filed Apr. 27, 1984, the disclosure of which is incorporated herein by reference.

BACKGROUND OF THE INVENTION

This invention relates to the use of a heat-activatable sealing piston in thermal actuators and in particular it relates to the use of such a piston in an electrical connector.

In U.S. patent application Ser. No. 483,997, filed Apr. 11, 1983, there is disclosed an electrically conductive connector for electrical conductors. In some embodiments, a solid slug of solder is positioned in the base of the connector and a conductor is then inserted. When sufficient heat is applied to melt the solder, a pressuring means forces the solder between the conductor and the side walls of the connector and, if a stranded conductor is used, between the strands of the conductor. A preferred pressuring means comprises a piston and a composition which on application of heat evolves a gas. On continued heating, the solder melts and the pressure of the evolved gas acts on the piston causing it to move toward the open end of the connector and force the solder between the conductor and connector. A problem encountered with this embodiment is the difficulty of providing a seal around the piston to prevent leakage of the gas or the gas evolving substance before sufficient pressure has been developed.

This invention provides a sealing piston which can be used in such a connector. Further, the sealing piston is capable of use in other systems or apparatus such as thermal actuators which operate, for example, a relief valve. This invention provides a heat activatable sealing piston which, when positioned within a tube and heated, expands and provides a seal between the piston and the walls of the tube which on application of pressure is capable of axial motion within the tube while maintaining the seal.

Heat expandable devices are known. For example, heat expandable rivets and the like have been proposed in the art. See for example Swiss Patent No. 423,209 to Dynamit Nobel and U.S. Pat. No. 2,458,152 to Eakins. The heat expandable rivets described in these patents are used to securely fasten one object to another. Movement of the rivet after installation is not possible nor is it desirable.

U.S. Pat. No. 3,243,211, to Wetmore, mentions the use of heat expandable tubular articles. The use of such articles closed at one end can be used to plug, for example, pipes or other conduits. In accordance with the Wetmore invention, a fusible member, such as an adhesive, is positioned on the expandable article. On application of heat, the fusible member melts and flows. As a result, the plug is securely bonded to the inner walls of the pipe.

The use of a sealing piston in thermal actuators is described in U.S. Pat. No. 3,302,391, to Mihm. In this patent an elastomeric plug is used as a sealing piston within a tube. To effect the seal, washers are provided at each end of the plug and a screw, which extends through the plug and washers, can be tightened to cause the plug to expand radially and thereby form a seal between the plug and the walls of the tube. The plug is positioned within the tube on top of a column of heat expandable material, such as wax which expands on melting. When heated the material melts and expands and, since it is confined by the walls of the tube, the expansion is in the axial direction. The elastomeric plug is subjected to an axial force which produces an increase in the radial pressure exerted by the plug on the walls of the tube and causes the plug to move longitudinally in the tube thereby operating a relief valve to which it is connected. The assembly can be used, for example, in a hot water tank. Similar devices are disclosed in U.S. Pat. Nos. 3,194,009 to Baker and 3,319,467 to Feinberg.

SUMMARY OF THE INVENTION

This invention provides a radially expandable piston which when positioned within a tube and heated, expands to form a seal between the piston and the inner walls of the tube. Further, on application of sufficient axial force on the piston, the piston is capable of maintaining said seal while moving in the axial direction. The heat expand-able piston can be used in an electrical connector as described above using pressurized gas to move the piston without encountering the problem of gas leakage. Further, the piston has an initial diameter less than the internal diameter of the tube with which it is used, making thermal actuators and the like using the piston more easily assembled than the actuators described in the above mentioned references.

One aspect of this invention provides a method of producing a sealing piston within a hollow, relatively rigid tubular article which comprises:

(a) forming a cylinder of polymeric material, said cylinder having a diameter to length ratio less than 4.5:1;

(b) placing said cylinder within a tubular article which has an internal diameter greater than the diameter of the cylinder by an amount of up to about 300%;

(c) heating to effect radial expansion of the cylinder causing it to exert a pressure on the walls of said tubular article thereby forming a seal between the cylinder and the walls of the tubular article;

(d) exerting an axial pressure on said cylinder causing it to move axially within the tubular article while maintaining the seal between the cylinder and the walls of the tubular article.

Another aspect of this invention comprises an electrically conductive connector for electrical conductors comprising:

(a) at least one metallic tubular sleeve having an open end for receiving an electrical conductor and a closed end, the peripheral inner wall of the sleeve being pretinned, the sleeve being sized to receive a slug of solder therein proximate to the closed end;

(b) a cylinder of heat expandable polymeric material, said cylinder having a diameter to length ratio less than 4.5:1 and having a diameter in the unexpanded state of less than the inner diameter of the sleeve and in the expanded state of greater than the inner diameter of the sleeve so that on application of heat, the cylinder will expand and exert a radial force against the walls of the sleeve thereby forming a seal between the disk and the walls of the sleeve; and (c) pressuring means between the cylinder and the closed end of the sleeve which on application of heat exerts sufficient force on the expanded cylinder to cause it to move toward the open end of the sleeve and to pressure the slug of solder toward the open end of the sleeve when the solder slug has melted.

DETAILED DESCRIPTION OF THE INVENTION

Figure 1A:
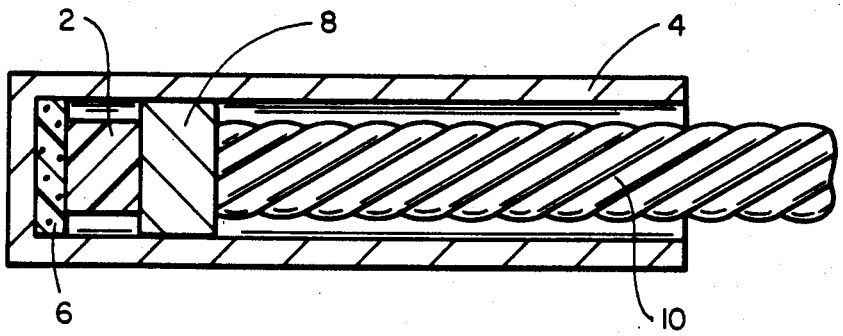
FIG. 1A shows a transverse cross-section of an electrical connector containing an unexpanded sealing piston, a gas generating means, a slug of solder and the connector which is to be connected to the conductor.

The heat activatable sealing-piston of this invention comprises a cylinder of polymeric material having a diameter to length ratio of less than about 4.5:1, preferably less than about 3.5:1 and most preferably less than about 2.5:1. The polymeric material may be a thermoplastic, thermoset or elastomeric or combinations thereof.

Thermoplastic materials which can be used include, for example, resins comprising, for example polyolefins and olefin copolymers for example polyethylene, polypropylene, ethylene/propylene copolymer and polybutenes; substituted polyolefins, for example, ethylene-vinyl acetate copolymer, ethylene-ethyl acrylate copolymer or other ethylene copolymers; substituted polyolefins, particularly halogen-substituted polyolefins, for example polyvinyl chloride, polyvinylidene chloride, polyvinylidene fluoride. Teflon 100 (a polytetra-fluoroethylene manufactured by Du Pont), Teflon FEP (a copolymer of tetrafluoroethylene and hexafluoro-propylene manufactured by Du Pont), Teflon PFA (a copolymer of tetra-fluoroethylene and perfluoroalkoxy moieties manufactured by Du Pont), Tefzel (a terpolymer of ethylene tetrafluoroethylene and a fluorinated monomer manufactured by Du Pont), and Halar (a copolymer of ethylene and chlorotrifluoroethylene manufactured by Allied Chemicals); polyesters, particularly segmented copolyester polymers, for example Hytrel (a segmented polyether ester copolymer derived from terephthalic acid, polytetramethylene ether glycol and 1,4-butanediol manufactured by Du Pont); polyurethanes; and styrene block copolymers, for example Kraton manufactured by Shell which are styrene-butadiene-styrene, styrene-isoprene-styrene and styrene-butylene-styrene block copolymers. Blends of one or more of these resins can be used to give the cylinder desired properties for the intended use.

Thermoset materials which can be used include, for example, epoxy resins, phenolic resins, acrylic resins, silicone resins, melamine resins, butadiene resins, polyesters and polyurethanes.

Elastomeric materials which can be used include elastomers comprising, for example, copolymers of dienes with olefinically unsaturated monomers, for example ethylene/propylene/non-conjugated diene terpolymers, styrene/butadienepolymers, butyl rubbers and copolymers of dienes with unsaturated polar monomers, for example acrylonitrile, methyl methacrylate, ethyl acrylate, vinyl pyridine and methyl vinyl ketone; halogen-containing elastomers, for example chloroprene polymers and copolymers, for example neoprene, chlorinated polyethylene, chlorosulphonated polyethylene, and Viton (a copolymer of vinylidene fluoride and hexafluoropropylene manufactured by Du Pont); copolymers of olefins with olefinically unsaturated esters, for example elastomeric ethylene/ vinyl acetate polymers, ethylene/acrylic acid ester copolymers for example ethylene/ethyl acrylate and methacrylate copolymers and particularly ethylene/acrylic rubbers, for example Vamac (a terpolymer of ethylene, methyl acrylate and a curesite monomer manufactured by Du Pont); acrylic rubbers, for example polyethyl acrylate, polybutyl acrylate, butyl acrylate/ethyl acrylate copolymers, and butyl acrylate/glycidyl methacrylate copolymers; silicone elastomers, for example polydiorganosiloxanes, copolymers, block copolymers, and terpolymers of monomethylsiloxanes, dimethylsiloxanes, methylvinylsiloxanes and methylphenylsiloxanes, fluorosilicones, for example those derived from 3,3,3-trifluoropropyl siloxane and carborane siloxanes; elastomeric polyurethanes; and polyethers, for example epichlorohydrin rubbers. Blends of two or more elastomers can also be used.

The cylinder can comprise a single polymeric material or can comprise two or more materials. For example, to provide a cylinder of the desired modulus and desired surface properties, the cylinder can comprise a central core of thermoplastic material with a layer of elastomer material surrounding the core. The reverse can also be used, e.g. an elastomeric core and a thermoplastic outer layer.

The material is preferably cross-linked by irradiation or by chemical means. For example, the material can be subjected to gamma irradiation from a source such as cobalt 60, or by high energy electrons from an electron beam. Cross-linking promotors such as allyl isocyanates, allyl cyanates, acrylate and methacrylate monomers or the like can be incorporated into the material to provide the desired degree of crosslinking. Cross-linking by chemical means comprises the incorporation of a cross-linking agent into the material and permitting it to cross-link. Heat may be applied to initiate such chemical cross-linking. Cross-linking agents which may be used include, organic peroxides, hydroperoxides, sulfur, phenolic resins, quinone dioxime, nitrobenzene and metal oxides. Cross-linking by subjecting the polymer to irradiation is preferred.

One method of preparing the cylinder comprises extruding a sheet of the polymeric material having a thickness approximately equal to the desired length of the cylinder, for example, about 1 to about 25 millimeters. Cylinders of the desired diameter can then be stamped from the sheet. The cylinder can also be prepared by extruding a continuous rod of the material having the appropriate diameter. The rod can then be cut into individual cylinders of the desired length. The diameter to length ratio of the cylinder should be less than about 4.5:1, preferably less than about 3.5:1 and most preferably less than about 2.5:1. If the diameter to length ratio is greater than about 4.5:1, the cylinder is likely to tilt in the tubular article and is likely not to function as a sealing piston, since, when tilted, it is unable to maintain the seal between the cylinder and the walls of the tube.

When the cylinder is subjected to heat, the diameter expands due to thermal expansion of the material. In order to provide a seal between the cylinder and the walls of the tubular article, the cylinder should be sized such that in its non-expanded state it has a diameter less than the diameter of the tube and when expanded would have a diameter greater than the inside diameter of the tube. The expandability of the cylinder should be in the range of from about 5% to about 300% of the diameter in the unexpanded state. A cylinder of polymeric material expands to a certain extent by thermal expansion of the material. In some applications, the degree of thermal expansion is adequate. However, in some instances a greater degree of expansion is desired. This can be achieved by stretching the cylinder in the axial direction at elevated temperature and cooling the cylinder while restraining it in the stretched configuration. Stretching the cylinder causes the diameter to decrease. On application of heat the cylinder will recover to its unstretched configuration causing the diameter to recover to or toward its initial dimensions. In embodiments of the invention in which the cylinder is stretched longitudinally to provide greater radial expansion, the material of the cylinder should comprise a crosslink thermoplastic or a multi-layer structure having, for example a core of thermoplastic with an outer layer of an elastomer, or vice versa.

Figure 1B:
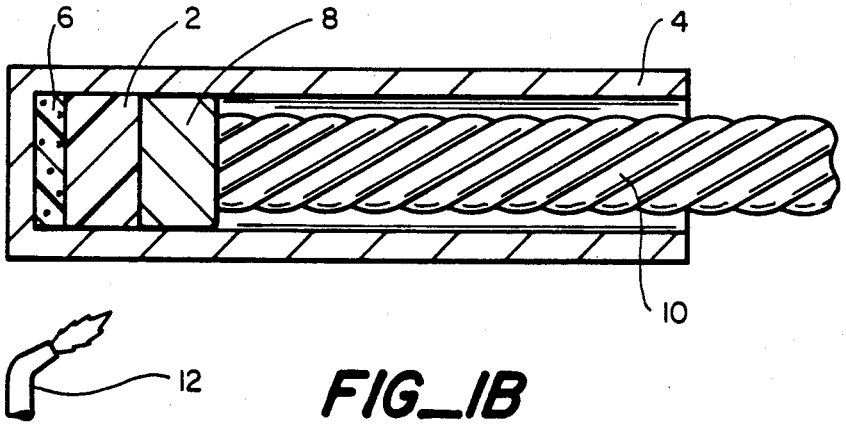
FIG. 1B shows an intermediate stage in the installation of the connector, illustrating the sealing piston after expansion thereof to form a seal between the piston and the inner wall of the sleeve.
Figure 1C:
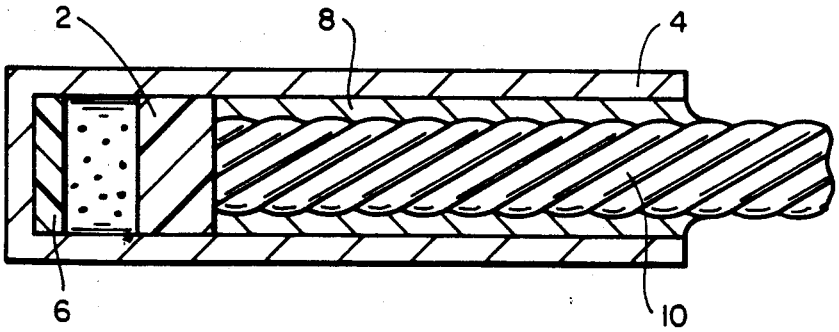
FIG. 1C shows the completed connection in which the gas generating means has acted on the sealing piston to force molten solder between the conductor and connector.

The use of a heat expandable sealing piston in accordance with this invention will be more fully understood by referring to the accompanying drawings. In the drawings, FIGS. 1A, 1B and 1C illustrate use of the sealing piston in an electrical connector. In the Figures, a heat expandable cylinder 2, of crosslinked high density polyethylene, is positioned in a metallic tubular sleeve, 4, having an open end and a closed end. As discussed in above mentioned copending application, Ser. No. 483,997, the disclosure of which is incorporated herein by reference, this sleeve may represent a terminating lug for an electrical conductor or may represent one portion of a connector connecting two, or more electrical conductors, for example, the closed end of the sleeve may be integral with a similar sleeve, or a sleeve adapted to receive two conductors and thereby form a Y-splice of two conductors on one side, one on the other. As discussed in the copending application, the inner surface of the metal sleeve is preferably pretinned.

Between cylinder, 2, and the closed end is a gas generating means, 6. The gas generating means illustrated is a disk of silicone resin containing a gas generating substance such as 5-phenyl tetrazole and its calcium or barium salts, which on heating generates nitrogen gas. As discussed in above mentioned Ser. No. 483,997, other pressurizing means can be used, for example a compressed spring, to apply pressure to the piston.

The surface of the heat expandable cylinder facing the pressurizing means may have a concave configuration. This has been found to be particularly advantageous when the pressurizing means comprises a gas generating means. The cavity formed by the concave surface enables the generated gas to partially expand before the solder has melted resulting in greater control over the amount of pressure exerted on the molten solder. Further, the hollowed out or concave configuration permits deformation of the side walls of the cylinder into the cavity if there is significantly axial expansion of the cylinder on heating. This prevents elongation of the cylinder which might otherwise dislodge the conductor from its position in the sleeve. When the cylinder has a concave surface, the effective length of the cylinder is the average distance through the cylinder taking into consideration the concave configuration.

A slug of solder, 8, is positioned next to the cylinder on the side toward the open end of the sleeve. Conductor 10 is inserted in the open end of the sleeve and contacts solder slug 8. FIG. 1A shows the connector just after the conductor has been inserted. In FIG. 2B, heat has been applied by means of a propane torch 12. Sufficient heat has been applied to cause the piston to expand forming a seal between the cylinder 2 and the inner surface of the walls of the metal tubular sleeve 4. Solder slug 8 has not yet melted. On continued heating the pressure on the gas generated by the gas generating means, 6, increased. When sufficient heat has been applied, the solder melts and the pressure built up by the gas generating means forces cylinder, 2, to force the solder, 8, between conductor, 10, and the connector, 4. This is illustrated in FIG. 1C which shows the completed installation of the conductor. As is readily evident, the gas tight feature of the seal between cylinder, 2, and sleeve, 4, makes possible the build up of pressure of the gas generated by means, 6, to a sufficient level to force the cylinder, 2, toward the open end of the connector forcing the molten solder ahead of it. The gas generating means thus should generate gas at a temperature somewhat lower than the melting point of the solder. In other words, on application of heat, the cylinder should expand first followed by gas generation and pressurization, and then melting of the solder.

On cooling the installed connection, the cylinder will contract and no longer form a seal between the cylinder and the metal sleeve which, since the solder has by then been forced between the conductor and connector and solidified, this is of no consequence. In other embodiments however, this feature provides reversibility of the seal. In other words, the cylinder forms a gas tight seal at elevated temperatures repeatedly. This is advantageous when the cylinder is used as a piston in a thermal actuator such as a relief valve. The valve can be made to open when pressure behind the piston is sufficient to cause it to move axially and when conditions have returned to e.g. ambient temperature, the piston contracts and the valve is permitted to close. On reheating, the cycle is repeated. This piston thus is suitable for use in a relief valve for a hot water tank or the like. Instead of operating a relief valve, motion of the sealed piston can be reflected on a measuring or detecting mechanism to provide a means for determining pressure build up in such a system.

While the invention has been described herein in accordance with certain preferred embodiments thereof, many modifications and changes will be apparent to those skilled in the art. Accordingly, it is intended by the appended claims to cover all such modifications and changes as fall within the true spirit and scope of the invention.

We claim:

1. A method of producing a sealing piston within a hollow, relatively rigid tubular article which comprises:

(a) forming a cylinder of polymeric material, said cylinder having a diameter to length ratio less than 4.5:1;

(b) placing said cylinder within a tubular article which has an internal diameter greater than the diameter of the cylinder by an amount of up to about 300%;

(c) heating to effect radial expansion of the cylinder causing it to exert a pressure on the walls of said tubular article thereby forming a seal between the cylinder and the walls of the tubular article;

(d) exerting an axial pressure on said cylinder causing it to move axially within the tubular article while maintaining the seal between the cylinder and the walls of the tubular article.

2. A method in accordance with claim 1 wherein expansion of the cylinder is due to recovery of the cylinder from a stretched configuration toward an original unstretched configuration, thereby causing increased radial expansion.

3. A method in accordance with claim 1 wherein pressure is exerted on said cylinder by pressurized gas.

4. A method in accordance with claim 3 wherein said pressurized gas is formed in situ by heating a gas generating means positioned within said tubular article.

5. A method in accordance with claim 1 wherein said cylinder comprises a crosslinked thermoplastic.

6. A method in accordance with claim 5 wherein said crosslinked thermoplastic is crosslinked polyethylene.

7. An electrically conductive connector for electrical conductors comprising:

(a) at least one metallic tubular sleeve having an open end for receiving an electrical conductor and a closed end, the inner wall of the sleve being pretinned, the sleeve having an inner diameter sized to receive a slug of solder therein proximate to the closed end;

(b) a cylinder of heat expandable polymeric material, said cylinder having a diameter to length ratio less than 4.5:1 and having a diameter in the unexpanded state of less than the inner diameter of the sleeve and in the expanded state of greater than the inner diameter of the sleeve so that on application of heat, the cylinder will expand and exert a radial force against the walls of the sleeve thereby forming a seal between the cylinder and the walls of the sleeve; and (c) pressuring means between the cylinder and the closed end of the sleeve which on application of heat exerts sufficient force on the expanded cylinder to cause it to move toward the open end of the sleeve and to pressure the slug of solder toward the open end of the sleeve when the solder slug has melted.

8. A connector in accordance with claim 7 wherein said pressuring means is a compressed spring.

9. A connector in accordance with claim 7 wherein said cylinder comprises a crosslinked thermoplastic.

10. A connector in accordance with claim 9 wherein said crosslinked thermoplastic is crosslinked polyethylene.

11. A connector in accordance with claim 7 wherein said pressuring means comprises a gas evolving substance.

12. A connector in accordance with claim 11 wherein said gas evolving substrance is 5-phenyl tetrazole.

13. A connector in accordance with claim 11 wherein said gas evolving substance is in a silicone rubber.

* * * * *